US006966721B2

(12) United States Patent
Sato et al.

(10) Patent No.: US 6,966,721 B2
(45) Date of Patent: Nov. 22, 2005

(54) WRAP-AROUND NOTEBOOK

(75) Inventors: Jay K. Sato, Mission Viejo, CA (US); Paul Whaley, Herculaneum, MO (US)

(73) Assignee: Avery Dennison Corporation, Pasadena, CA (US)

( * ) Notice: Subject to any disclaimer, the term of this patent is extended or adjusted under 35 U.S.C. 154(b) by 148 days.

(21) Appl. No.: 10/633,283

(22) Filed: Aug. 1, 2003

(65) Prior Publication Data

US 2005/0025563 A1 Feb. 3, 2005

(51) Int. Cl.[7] ..... B42F 3/00

(52) U.S. Cl. ..... 402/73; 281/15.1; 281/28; 281/29; 281/36; 281/37; 281/38; 281/40; 402/26; 402/70; 402/72; 402/73; 402/76; 402/77; 402/79; 402/80 R; 24/67 R

(58) Field of Search ..... 402/26, 73, 79, 402/80 R, 70, 72, 76, 77; 24/67 R; 281/15.1, 281/36, 37, 38, 40, 28, 29

(56) References Cited

U.S. PATENT DOCUMENTS

| | | | | |
|---|---|---|---|---|
| 908,596 A | | 1/1909 | Morden | |
| 1,152,702 A | | 9/1915 | Brown | |
| 1,740,936 A | | 12/1929 | Watson | |
| 1,827,592 A | | 10/1931 | Lewis | |
| 2,722,434 A | | 11/1955 | Wolfe | |
| 3,263,687 A | | 8/1966 | Weichert | |
| 3,620,553 A | * | 11/1971 | Donovan | 462/24 |
| 4,315,696 A | | 2/1982 | Ermanski et al. | |
| 4,811,973 A | * | 3/1989 | Kumar-Misir | 281/27.2 |
| 4,848,948 A | | 7/1989 | Pitts | |
| 4,880,327 A | | 11/1989 | Sanabria | |
| 4,904,103 A | * | 2/1990 | Im | 402/35 |
| 4,941,804 A | | 7/1990 | Sarpy, Jr. | |
| 4,981,386 A | | 1/1991 | Beleckis | |
| 5,697,646 A | * | 12/1997 | Venegas | 281/37 |
| 6,168,338 B1 | * | 1/2001 | Young | 402/26 |
| 6,206,602 B1 | | 3/2001 | Yamamoto et al. | |
| 6,209,917 B1 | | 4/2001 | Welch | |
| 6,220,632 B1 | | 4/2001 | Rosebush | |
| 6,349,969 B1 | | 2/2002 | Spaeth et al. | |

(Continued)

FOREIGN PATENT DOCUMENTS

GB 1190176 A 4/1970

*Primary Examiner*—Boyer D. Ashley
*Assistant Examiner*—Mark Henderson
(74) *Attorney, Agent, or Firm*—Scott R. Hansen; Fulwider Patton Lee & Utecht LLP

(57) ABSTRACT

A wrap-around notebook or binder includes a ring assembly with a shield and a pair of frames forming a bistable construction, and a hinge plate pivotally coupled to the shield with the outer surface of the hinge plate aligned with the outer extent of the shield/frame assembly when the hinge plate is parallel to the plane of the shield. The exposed frame member may be convex, recessed to receive rivet heads, and may be plated. The hinge plate(s) may have curls which interfit with alternate curls from the shield to provide a hinge. The ring assembly may be mounted in the notebook or binder so that the shield side of the ring assembly faces the front cover of the binder. The pivot line between the shield and the hinge plate may be spaced from the shield by a clearance distance. The notebook or binder lies flat on an underlying surface with either the front cover of the rear cover folded under the assembly.

20 Claims, 5 Drawing Sheets

U.S. PATENT DOCUMENTS 6,371,679 B1 4/2002 Peleman
6,435,753 B1 * 8/2002 Gusack ..... 402/73
6,702,330 B2 * 3/2004 Roca ..... 281/21.1
6,746,171 B2 * 6/2004 Welch ..... 402/36
2002/0015613 A1 * 2/2002 Kapur et al. ..... 402/73
2005/0097732 A1 * 5/2005 Sato et al. ..... 29/798

* cited by examiner

WRAP-AROUND NOTEBOOK

FIELD OF THE INVENTION

This invention relates to notebooks or binders of the "wrap-around" type.

BACKGROUND OF THE INVENTION

Conventional ring binder notebooks have a ring assembly secured to the binding or to one of the two covers of the notebook near the binding. The ring mechanism normally has three rings mounted so that there are two stable positions for the rings, with the rings being either open to facilitate insertion or removal of sheets of paper, or closed to hold the sheets in place. To obtain these two stable positions for the rings, an assembly is provided using two long stiff rectangular plates, known in the binder field as "frames".

These two frames are pivotally coupled together along an inner longitudinal edge of each frame. A springy overlying metal strip known in the binder field as a "shield", engages the outer edges of the two strips and biases them inward to provide two bistable states for the frames, with the frames making an oblique angle relative to one another, with the central hinge line shifting in one direction for one of the stable positions, and in the opposite direction for the other stable position.

The shield and frames assembly is normally riveted flat against the spine of the notebook or into one of the covers of the notebook, with the shield exposed and the frames concealed by proximity to the spine or one cover of the notebook. The rings extend through clearance openings in the shield and are secured to the frames, with all six partial rings being secured to the sides of the frames facing the shield. The exposed shield is normally plated with nickel or chromium, while the concealed frames are normally formed of flat steel strips, and are not coated, and have exposed rivet protrusions where the half rings are secured to the frames.

In contrast to conventional notebooks, reference is made to C. K. Young U.S. Pat. No. 6,168,338 entitled "Wrap Around Notebook", granted Jan. 2, 2001. The Young patent has advantages for certain applications as compared with conventional binders, in that it can more readily lie flat with the covers open, and with the covers and all of the sheets overlying one another so that it takes up very little space on a podium, or a small desk or table, for examples.

In the construction of the Young wrap-around notebook, it may be noted that three of the half rings are secured (normally riveted) to one side of one of the frame members facing the shield, and that the mating set of three half rings are secured to the other side of the other frame member facing away from the shield. In addition, the frame and shield assembly is not secured flat against the spine, but the shield is pivotally mounted to a hinge plate, which is riveted to one of the covers of the Young notebook adjacent the spine.

The notebook disclosed in the Young patent has certain shortcomings. Thus, for example, it can be difficult to secure the hinge plate to the spine or to a cover of the assembly with the hinge plate being in a different plane from the upper surface of the shield. In addition, the flat unfinished frames with protruding ring rivets are rough and unsightly, so that in some cases a second shield was considered desirable to improve the appearance of the notebook. Further, the length of the frame and shield assembly is longer than necessary in view of the fact that "boosters" to assist in opening the rings are not needed.

SUMMARY OF THE INVENTION

In accordance with the present invention a wrap-around notebook or binder includes improved features including one or more of the following:

1. The shield has laterally extending strips along its length, on the side of the shield where the half rings are secured to the top of the frame toward the shield, and the strips are curled to form a hinge mating with a similar curl on a hinge plate, and with the plane of the hinge plate aligned with the maximum extent of the shield/frame assembly, either the shield side or the frame side thereof. The hinge is preferably formed by the alternate curls on the hinge plate and on the strips extending from the shield, with a pivot wire extending through the curls.

2. The frames may be convexly curved, with recessed areas to receive ring rivets, to present a smooth exposed frame side configuration, both for mechanical and aesthetic considerations.

3. The frame/shield assemblies are shortened with respect to the height of the notebook to reduce costs, and the ends are curved to avoid sharp corners, and to improve the aesthetic appearance of the shield/frame assembly.

4. The single hinge plate extending the majority of the length of the frame/shield assembly may be replaced by two small hinge plates located to include the the rivet openings for securing the shield/frame assembly to the binder, as a cost reduction step.

5. The exposed frame members are plated with a silver colored plating, such as nickel, zinc or chromium, to preclude rusting and to provide a more aesthetically pleasing appearance.

6. The shield/frame/hinge plate assembly may be mounted in the notebook with the hinge pivot axis near a corner between the spine and one cover of the notebook with the shield side facing the front cover of the notebook.

7. The ring assembly with features as outlined above may be employed without the hinge plate for use in a "spiral notebook" type configuration.

8. The hinge line between the shield and the hinge plate may be spaced away from the shield by a clearance distance so that the binder will lay flat with either cover folded under the notebook assembly.

Advantages of the present design include an improved aesthetic configuration, a reduction in costs resulting from eliminating the need for a second shield, reduction in the length of the ring assembly, and optionally using two small hinge plates instead of one long hinge plate.

Other objects, features and advantages of the invention will become apparent from a consideration of the following detailed description and the accompanying drawings.

DETAILED DESCRIPTION OF THE PREFERRED EMBODIMENTS

While the specification describes particular embodiments of the present invention, those of ordinary skill can devise variations of the present invention without departing from the inventive concept.

Figure 1:
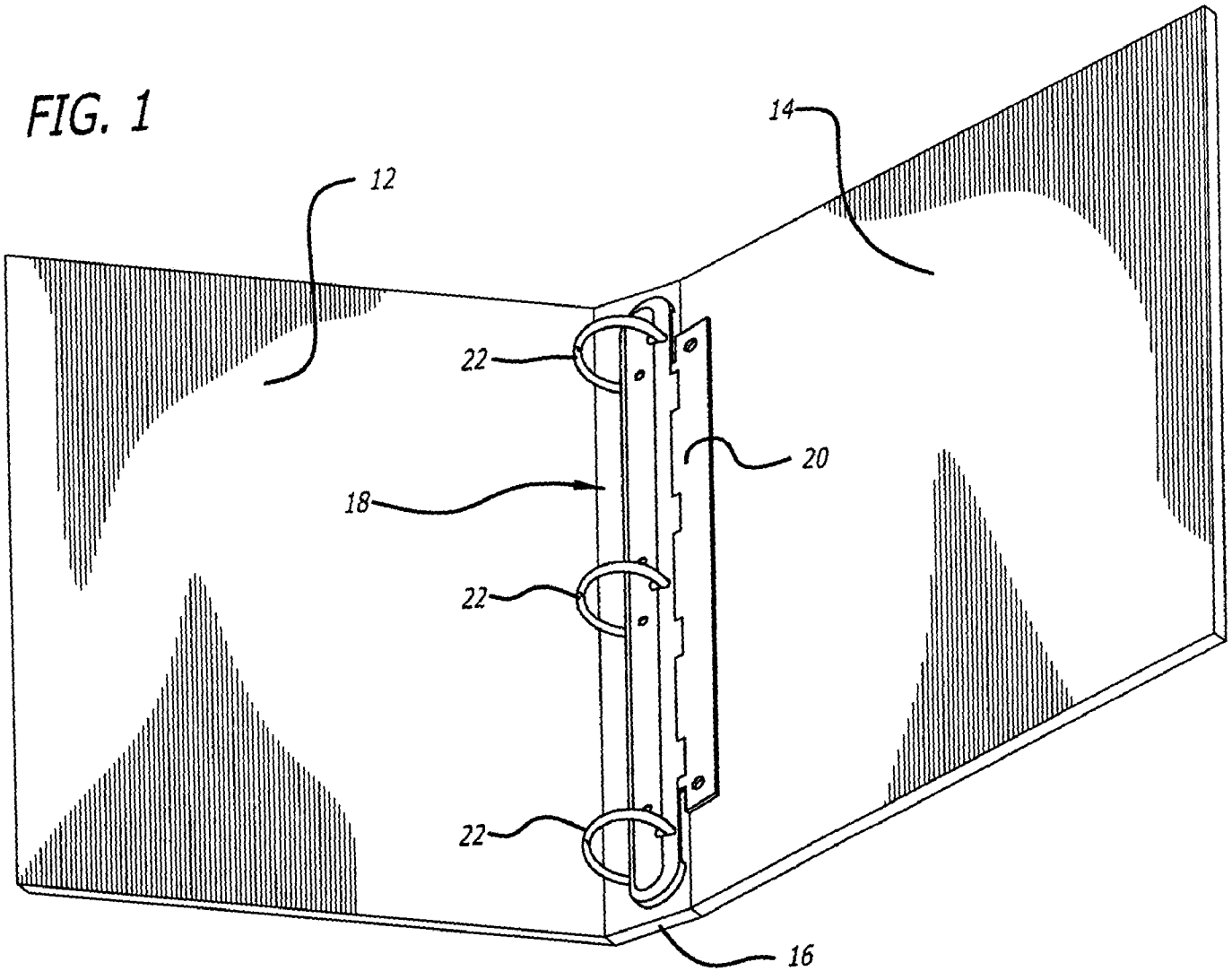
FIG. 1 shows a binder with a ring assembly, which includes a construction illustrating the principles of the invention.

Referring more particularly to the drawings, FIG. 1 shows a notebook having two covers 12, 14 and a spine panel 16 hinged to the two covers. A ring assembly 18 is shown pivotally mounted to the notebook by the hinge panel 20. The rings 22, which may be opened or closed, are mounted on frames included in the ring assembly as discussed in greater detail hereinbelow.

Figures 2, 7:
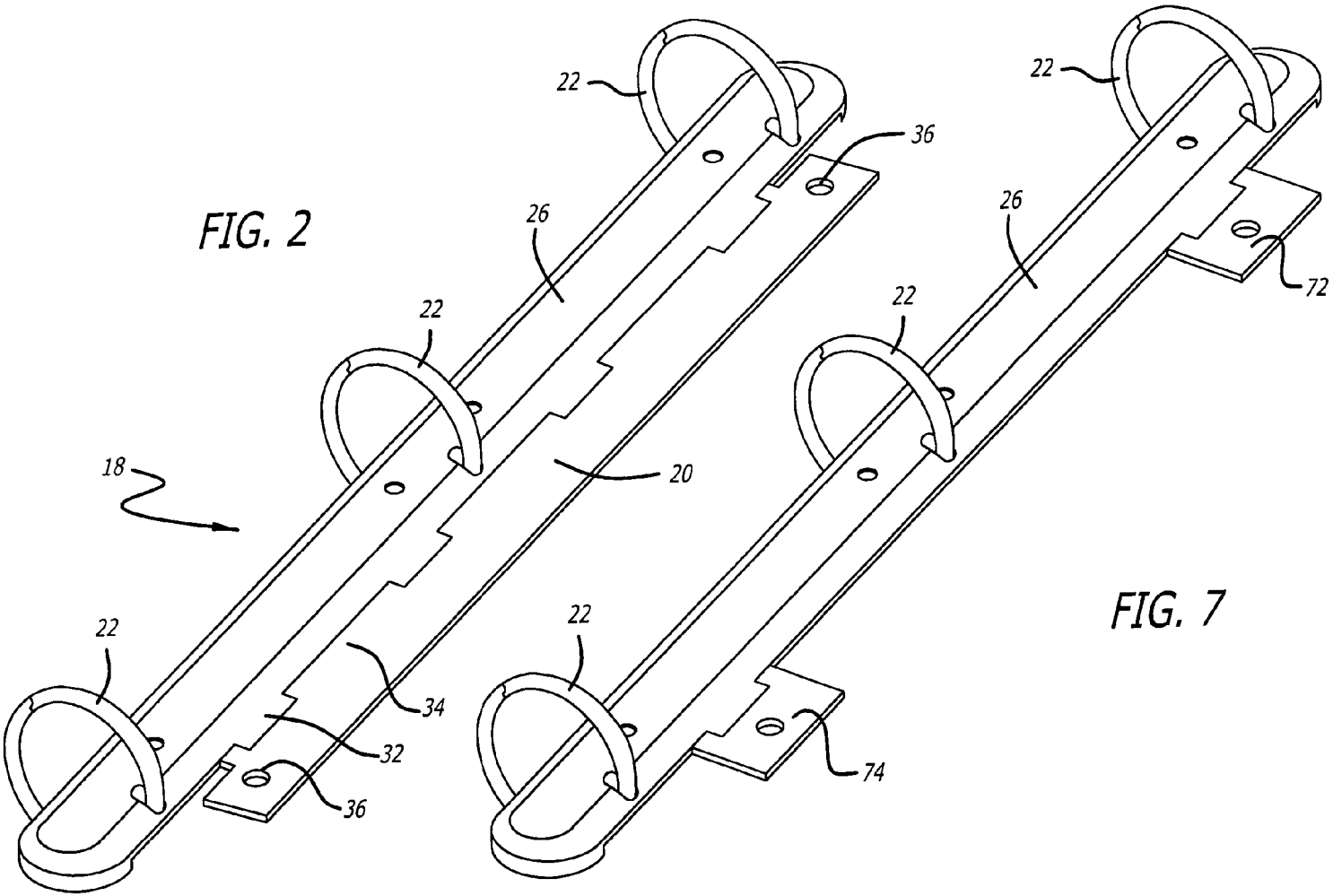
FIG. 2 is a perspective view, showing the ring assembly including the rings, the shield, and the hinge plate, with the frames being concealed by the shield.
FIG. 7 illustrates an alternative embodiment employing two short hinge plates, instead of a single long hinge plate.

FIG. 2 is a perspective view of the ring assembly 18 and the hinge plate 20. The pivot between the ring assembly 18 and the hinge plate 20 is implemented by alternate lateral extensions from the shield 26 and the hinge plate 20, which extensions are curled to have a central aligned opening through which a wire extends. The first curl from the shield 26 may be noted at reference numeral 32, and the first curl from the hinge plate may be noted at reference numeral 34.

The rivet holes 36 receive rivets to secure the hinge plate and ring assembly to the notebook.

Figure 3:
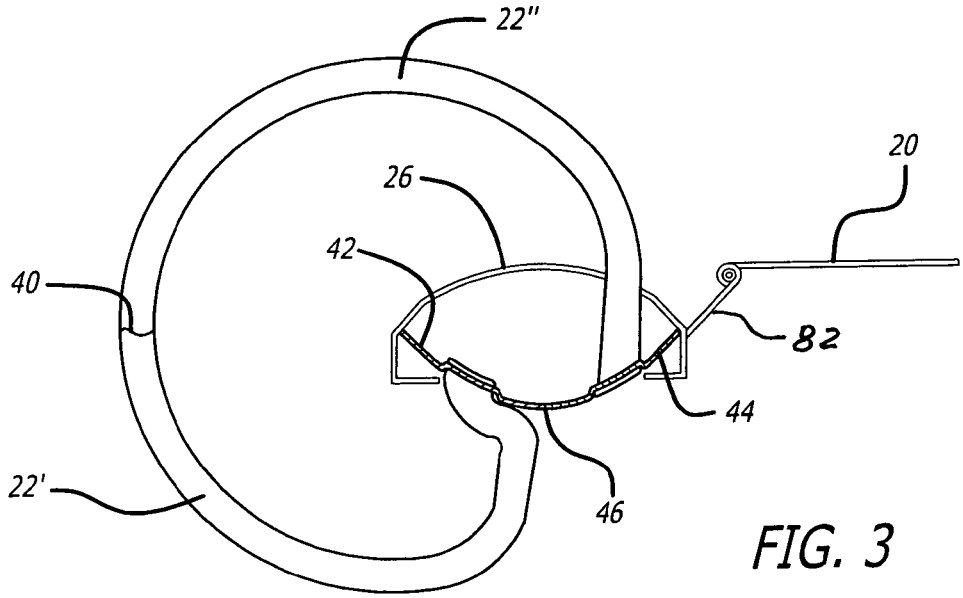
FIG. 3 is a partial cross-sectional view showing the curved frame members and with the rings in the closed position; and with the hinge plate aligned with the apex of the shield.

FIG. 3 is a partial cross-sectional view, showing the two half rings 22' and 22" which engage at the V-shaped junction 40. Also shown in FIG. 3 are the shield 26 and the hinge plate 20.

In operation, the two convexly curved frames 42 and 44 are pivotally coupled along line 46 in a conventional manner. The shield 26 is formed of springy, chrome-plated material, and exerts an inwardly directed biasing force on the outer edges of frames 42 and 44. The set of half rings 22" extend through clearance holes in the shield, and are secured to the upper side of frame 44 facing the shield. The other set of half rings 22' are secured to the bottom of frame 42, the side facing away from shield 26.

When the rings are opened, the pivot line 46 shifts upward, toward the shield 26, to the second bistable position.

In FIG. 3, the relative position of the upper surface of the hinge plate 20 relative to the shield 26 may be noted. Specifically, the upper surface of hinge plate 20 is aligned with the upper surface or apex of the shield 26 relative to the plane of shield 26 as defined by the lower edges thereof. With this configuration, the shield 26 and the upper surface of the hinge plate 20 will provide an even surface to help maintain the proper flat position of the hinge plate as the ring metal is fed through the riveting machine in which the hinge plate is riveted to the notebook.

Figure 4:
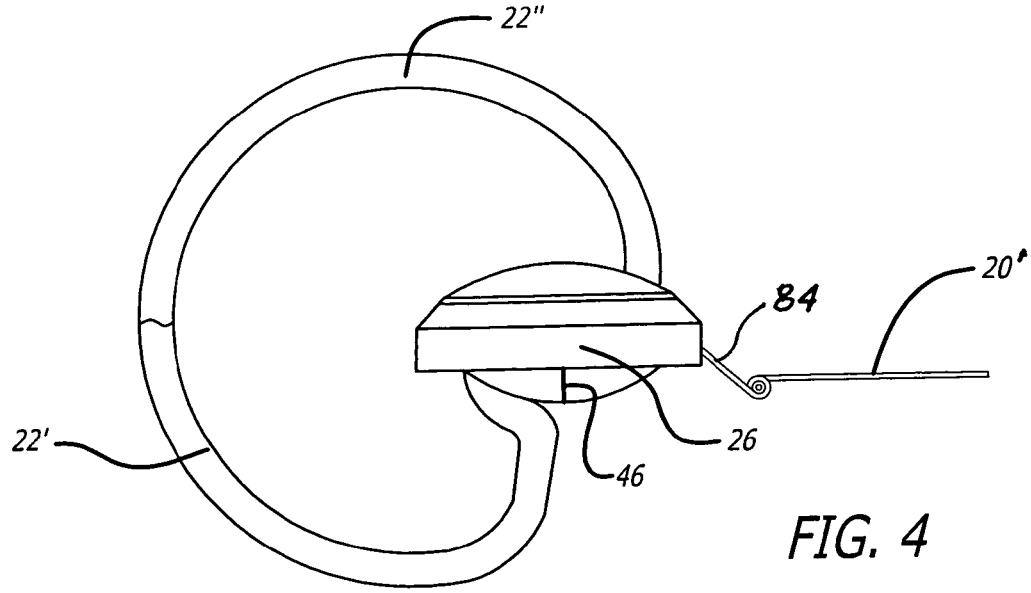
FIG. 4 is an end view showing the hinge plate extending outwardly from the ring assembly, and with the lower surface of the hinge plate aligned with the lower surface of the frames.

FIG. 4 is a view similar to FIG. 3, but with the lower surface of hinge plate 20' aligned with the lowermost surface of frames 42, 44. This facilitates the riveting of the hinge plate to the covers or spine panel of the notebook when a reverse riveted configuration of the ring/shield/frame assembly compared to FIG. 3 is desired with the bottom of the hinge plate 20' and the bottom of the frames 42, 44 engaging the guide surface to the riveting apparatus.

Figure 5:
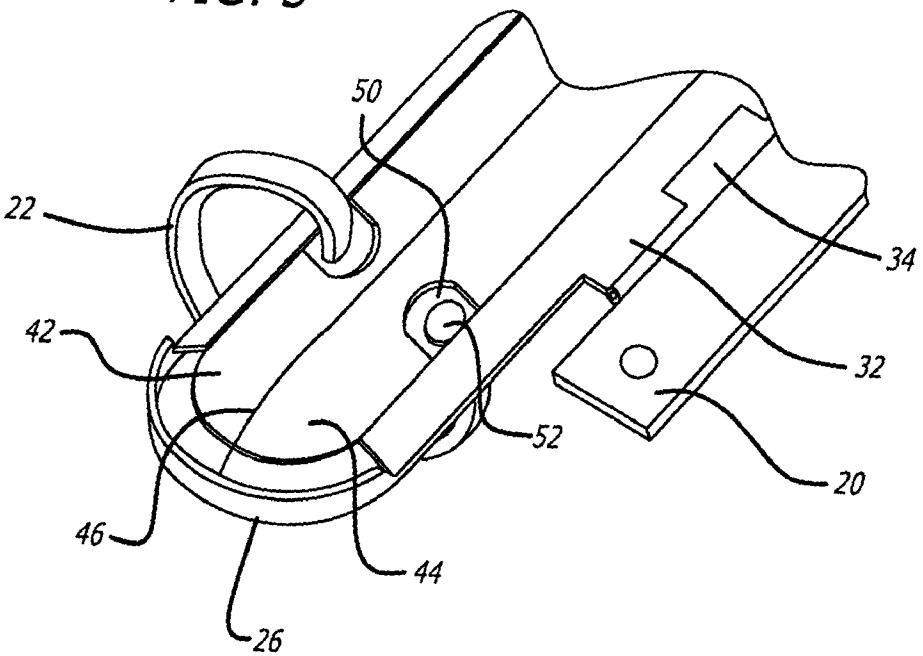
FIG. 5 is a perspective view of the bottom of one end of the ring assembly and the associated hinge plate.

FIG. 5 is a bottom view showing the frames 42, 44 and their pivot line 46. It may also be noted that recesses 50 are provided, with the rivet head 52 being formed in the recessed areas such as recess 50. In FIG. 5 the depending curved ends of the shield 26 are also visible. Also, the alternate curls 32 from the shield and 34 from the hinge plate may be seen to advantage.

Figure 6:
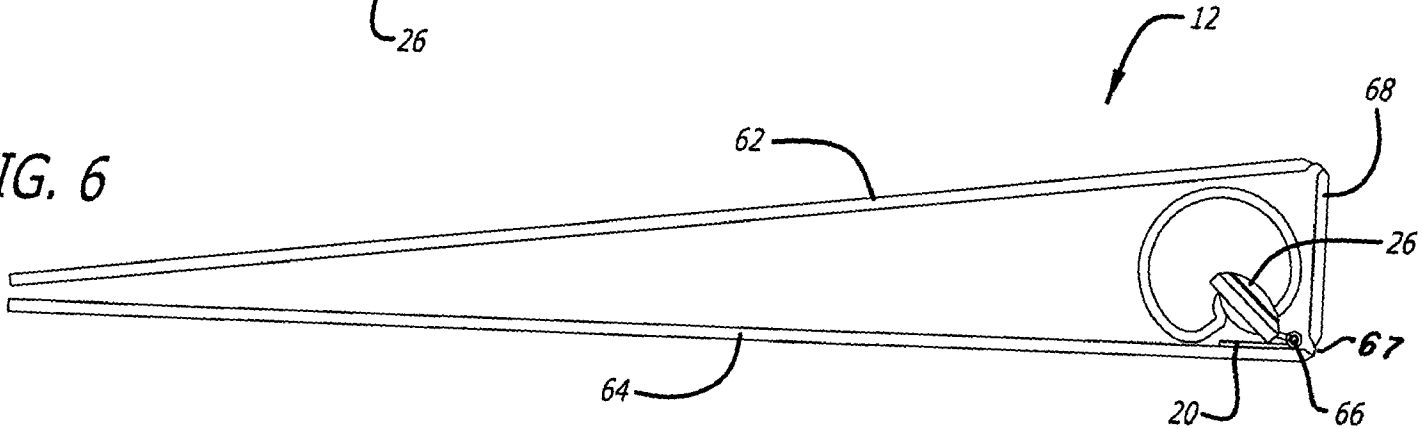
FIG. 6 is a side view showing the mounting of the ring assembly and hinge plate in a notebook.

FIG. 6 is a side view of an assembled notebook, with a front cover 62 and a rear cover 64. The hinge plate 20 is secured to the rear cover 64 but with the pivot line 66 between the hinge plate 20 and the shield 26 located near the pivot line 67 between rear cover 64 and the spine panel 68. With this configuration, when the front cover 62 is opened, the shield 26 is more prominent than the rear, or frame side of the ring assembly. The hinge plate could also be mounted on the spine panel and still maintain substantially the same location of the ring assembly hinge line.

FIG. 7 shows a further embodiment, in which two small hinge plates 72 and 74 are provided in place of the hinge plate 20 shown in other figures of the drawings. The location of the pivot axis in FIG. 7 is still substantially the same as in other figures of the drawing, with curls from the shield 26 mating with a curl from each of the two hinge plates 72 and 74.

Figure 8:
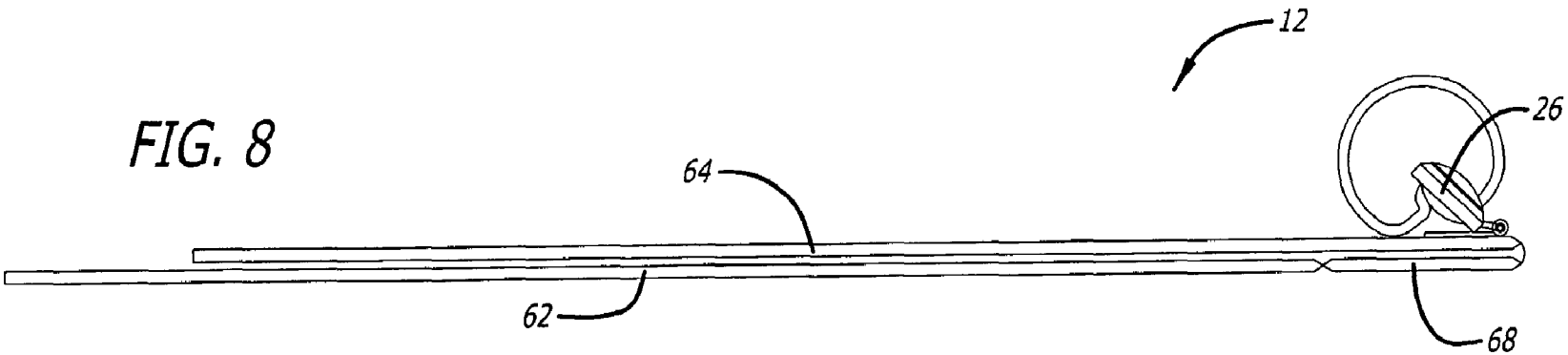
FIG. 8 shows the binder with the front cover and spine panel folded flat under the rear cover.

FIG. 8 shows the notebook 12 with the front cover 62 and spine panel 68 folded back. It may be noted that the notebook or binder 12 sits flat on an underlying surface so that it can be conveniently and stably mounted on a small surface such as a lectern or podium, for examples.

Figure 9:
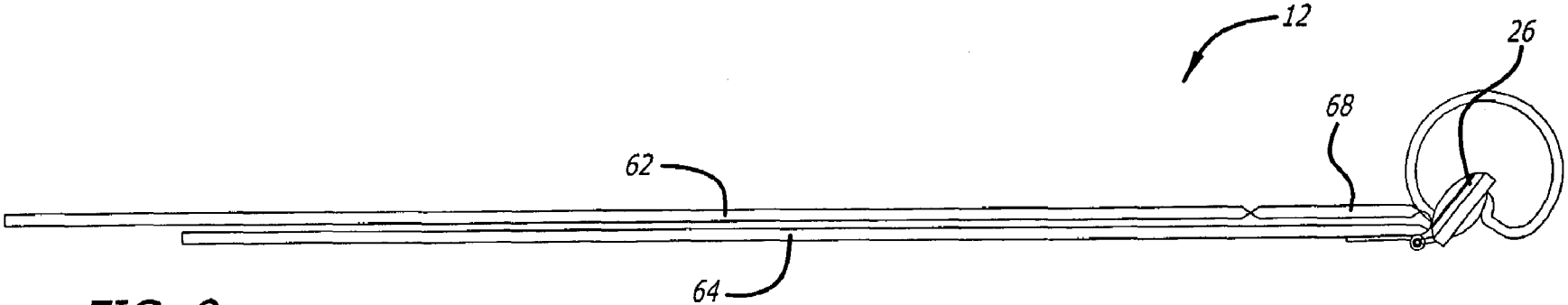
FIG. 9 is an end view showing the rear cover folded under the notebook which is configured to rest flat upon an underlying surface.

FIG. 9 shows another arrangement, in which the rear cover is folded under the front cover 62 and the spine panel 68, and the assembly still has the capability of lying flat on an underlying surface. Incidentally, these capabilities are facilitated by spacing the pivot between the shield and the hinge plate by a clearance distance 82 as shown in FIG. 3 and clearance distance 84 as shown in FIG. 4.

Concerning dimensions, for holding 8½×11-inch sheets, the dimensions of the covers of the binders would normally be approximately 9½ by 11½ inches. It is also noted that in the United States for 8½×11 inch size paper, the rings in three ring binders are normally spaced 4¼ inches apart, or with the outer rings about 8½ inches apart. For notebooks of this size, in one specific illustrative embodiment, the length of the ring assembly including the shields was slightly less than 9½ inches, and the rivet holes on the hinge plate or plates were spaced apart by about 7½ inches (7.562 inches). Thus, the length of the ring assembly including the curved shields may be substantially less than the 11½ inch height of the notebook, and may be ½ inch or 1 inch or more, less at each end of the ring assembly, relative to the notebook in which it is mounted. The foregoing dimensions are given by way of example and not of limitation. For A-4 paper and other size sheets the dimensions would be modified to implement the principles and constructions as discussed more generally in this specification.

In conclusion, in the foregoing detailed description and in the accompanying drawings, illustrative embodiments of the invention have been disclosed. It is to be understood however, that various changes and modifications may be made without departing from the sprit and scope of the invention. Thus, by way of example and not of limitation, different size notebooks and binders may be employed, with corresponding different dimensions for the ring assemblies. Binders with only two, or with many rings may be employed. The shield and frames assembly as disclosed may be used without the hinge plate(s), and front and rear covers employed without a spine panel, and with the covers apertured to fit on the rings. Accordingly, the invention is not limited to the precise embodiments shown in the drawings and described in detail hereinabove.

We claim:

1. A wrap-around notebook comprising:

a front cover, a rear cover and a spine pivotally coupled to the front and rear covers;

a ring assembly comprising two elongated frame members pivotally coupled together along one edge of each frame member;

a shield member made of springy metal biasing the frame members toward each other to provide first and second stable positions for the frame members, the shield member and the frame members together forming a shield/frame assembly;

a first set of half rings secured to one of the frame members on one side of the frame members; and a second mating set of half rings mounted on the other frame member on the other side of the frame members to engage the first set of half rings when the frame members are in the first stable position, and being spaced apart from the first set of half rings when the frame members are in the second stable position; and a hinge plate having an outer surface, said hinge plate pivotally secured to the shield member with the outer surface of the hinge plate being substantially aligned with the outer surface of the shield/frame assembly when the hinge plate is oriented parallel to the plane of the shield;

wherein the frame members are convexly curved outward.

2. A wrap-around notebook as defined in claim 1 wherein the shield is pivoted to the hinge plate by curls extending from the shield and mating curls formed along one edge of the hinge plate.

3. A wrap-around notebook as defined in claim 1 wherein the shield has ends, and the ends of the shield are curved and the length of the shield is substantially less than the top-to-bottom extent of the notebook covers.

4. A wrap-around notebook as defined in claim 1 wherein the frame members are recessed at the areas where the half rings are secured to the frames, to avoid protrusions on the frame side of the ring assembly.

5. A wrap-around notebook as defined in claim 1 wherein two hinge plates are provided.

6. A wrap-around notebook as defined in claim 1 wherein there is a pivot line between the hinge plate and the shield and a pivot line between the rear cover and the spine, and the ring assembly is mounted with the pivot line between the hinge plate and the shield extending along and immediately adjacent the pivot line between the rear cover and the spine, with the shield side of the ring assembly facing toward the front cover.

7. A wrap-around notebook as defined in claim 1 wherein the frame members are plated for corrosion protection and aesthetic appeal.

8. A wrap-around notebook as defined in claim 1 wherein there is a pivot line between the shield and the hinge plate, and the pivot line between the shield and the hinge plate is spaced from the shield by a clearance distance.

9. A wrap-around notebook or binder comprising:

a front cover and a rear cover;

a ring assembly comprising two elongated frame members pivotally coupled together along one edge of each frame member;

a shield member made of springy metal biasing the frame members toward each other to provide first and second stable positions for the frame members;

a first set of half rings secured to one of the frame members on one side of the frame members; and a second mating set of half rings mounted on the other frame member on the other side of the frame members to engage the first set of half rings when the frame members are in the first stable position, and being spaced apart from the first set of half rings when the frame members are in the second stable position; the frame members being convexly curved outward; and the covers being mounted to the ring assembly.

10. A wrap-around notebook or binder as defined in claim 9, wherein the shield has ends and the notebook covers have a top-to-bottom extent, and the ends of the shield are curved and the length of the shield is substantially less than the top-to-bottom extent of the notebook covers.

11. A wrap-around notebook as defined in claim 9 wherein the frame members are recessed at areas where the half rings are secured to the frames, to avoid protrusions on the frame side of the ring assembly.

12. A wrap-around notebook as defined in claim 9 wherein the frame members are plated for corrosion protection and aesthetic appeal.

13. A wrap-around notebook comprising:

a front cover, a rear cover and a spine panel pivotally coupled to the front and rear covers;

a ring assembly comprising two elongated frame members pivotally coupled together along one edge of each frame member;

a shield member made of springy metal biasing the frame members toward each other to provide first and second stable positions for the frame members, the shield member and the frame members together comprising a shield/frame assembly; and a first set of half rings secured to one of the frame members on one side of the frame members; and a second mating set of half rings mounted on the other frame member on the other side of the frame members to engage the first set of half rings when the frame members are in the first stable position, and being spaced apart from the first set of half rings when the frame members are in the second stable position; a hinge plate having an outer surface pivotally secured to the shield member with the outer surface of the hinge plate being substantially aligned with the outer surface of the shield/frame assembly when the hinge plate is oriented parallel to the plane of the shield;

the shield being pivoted to the hinge plate by curls extending from the shield and mating curls formed along one edge of the hinge plate; the frame members being convexly curved outward;

the shield having ends and the notebook covers having a top-to-bottom extent, the ends of the shield being curved and the length of the shield being substantially less than the top-to-bottom extent of the notebook covers;

the ring assembly having a frame side, the frame members being recessed at the areas where the half rings are secured to the frames, to avoid protrusions on the frame side of the ring assembly;

the ring assembly being mounted with the pivot line between the hinge plate and the shield extending along immediately adjacent the pivot line between the rear cover and the spine, with the ring assembly having a shield side, the shield side of the ring assembly facing toward the front cover; and the frames being plated.

14. A wrap-around notebook as defined in claim 13 wherein two hinge plates are provided.

15. A wrap-around binder comprising: a ring assembly comprising two elongated frame members pivotally coupled together along one edge of each frame member; a shield member made of springy metal biasing the frame members toward each other to provide first and second stable positions for the frame members; a first set of half rings secured to one of the frame members on one side of the frame members; and a second mating set of half rings mounted on the other frame member on the other side of the frame members to engage the first set of half rings when the frame members are in the first stable position, and being spaced apart from the first set of half rings when the frame members are in the second stable position; and the frame members being convexly curved outward; the binder further comprising front and rear covers mounted to the ring assembly.

16. A wrap-around notebook as defined in claim 15 wherein the shields have ends and the notebook covers have a top-to-bottom extent, and the ends of the shield are curved and the length of the shield is substantially less than the top-to-bottom extent of the notebook covers.

17. A wrap-around notebook as defined in claim 15 wherein the ring assembly has a frame side, and wherein the frame members are recessed at areas where the half rings are secured to the frame members, to avoid protrusions on the frame side of the ring assembly.

18. A wrap-around notebook as defined in claim 15 wherein the frame members are plated for corrosion protection and aesthetic appeal.

19. A wrap-around binder as defined in claim 15 wherein the shield member has a top, the binder further comprising a hinge plate pivotally connected to the shield member and aligned with the top thereof.

20. A wrap-around binder as defined in claim 15 wherein the frame members have an outermost extent, the binder further comprising a hinge plate pivotally connected to the shield, and aligned with the outermost extent of the frame members when the plane of the pivot plate is parallel with the plane of the shield.

* * * * *